US005954358A

United States Patent [19]

Bejean et al.

[11] Patent Number: 5,954,358

[45] Date of Patent: Sep. 21, 1999

[54] APPARATUS FOR RETAINING A SNOWBOARD BOOT ON A BOARD

[75] Inventors: Alain Bejean, Gruffy; Benoit Saillet, Albens, both of France

[73] Assignee: Salomon S.A., Metz-Tessy, France

[21] Appl. No.: 08/758,302

[22] Filed: Dec. 3, 1996

[30] Foreign Application Priority Data

Dec. 4, 1995 [FR] France ..... 95 15107

[51] Int. Cl.[6] ..... A63C 9/20

[52] U.S. Cl. ..... 280/627; 280/14.2

[58] Field of Search ..... 280/14.2, 611, 280/623, 624, 625, 627, 634, 635

[56] References Cited

U.S. PATENT DOCUMENTS

| | | | |
|---|---|---|---|
| 4,973,073 | 11/1990 | Raines et al. | 280/624 |
| 5,299,823 | 4/1994 | Glaser | 280/625 |
| 5,505,477 | 4/1996 | Turner et al. | 280/613 |
| 5,520,406 | 5/1996 | Anderson et al. | 280/624 |
| 5,595,396 | 1/1997 | Bourdeau | 280/607 |

FOREIGN PATENT DOCUMENTS

| | | | |
|---|---|---|---|
| 2689776 | 10/1993 | France | 280/14.2 |
| 2699828 | 7/1994 | France . | |
| WO 90/11109 | 10/1990 | WIPO . | |
| WO 96/05894 | 2/1996 | WIPO . | |

*Primary Examiner*—J. J. Swann
*Assistant Examiner*—Frank Vanaman
*Attorney, Agent, or Firm*—Greenblum & Bernstein, P.L.C.

[57] ABSTRACT

An apparatus for retaining a snowboard shoe on a board which includes a first anchoring device for the sole of the shoe; a second anchoring device affixed to the sole; a base affixed to the board and on which are mounted an arrangement for rotationally guiding and vertically retaining the first anchoring device and a mechanism for latching the second anchoring device, the mechanism including a jaw member having a housing for receiving the second anchoring device, and a latch journalled on the jaw member. The latching mechanism includes an elastic return device biased during the displacement of one portion at least of the latching mechanism which is driven by the thrust exerted by the second anchoring device moving vertically, substantially along an arc whose radius is equivalent to the distance separating the two anchoring devices during the tilting of the shoe about the axis of rotation of the first anchoring device. The apparatus combines the ease of automatically fitting the shoe with the controlled lateral slackness necessary for the practice of the sport.

19 Claims, 3 Drawing Sheets

APPARATUS FOR RETAINING A SNOWBOARD BOOT ON A BOARD

BACKGROUND OF THE INVENTION

1. Field of the Invention

The present invention relates to an apparatus or device for retaining a shoe, especially a snowboard shoe, on a gliding board such as a snowboard. The invention is also related to a shoe equipped to function with such device.

2. Background and Material Information

Users prefer flexible shoes for reasons related to comfort, mobility and sensation, and even to fashion trends. Such shoes are generally provided with a cover with a flexible upper made of leather, fabric or flexible plastic on a more or less rigid sole base. Reinforcement elements, stiffeners are arranged in certain portions of the shoe, as in the rear for example, to provide the support necessary for the practice of this sport.

One of the problems encountered results from the connection of this type of shoe or boot on the gliding board.

"Shell" type bindings are known which do not correctly meet the users' requirements in this regard. The shoe is maintained by means of systems with tightening straps and buckles. The adjustment of these systems is time-consuming and must be repeated at the beginning of each run and under conditions that are sometimes uncomfortable for the user. The necessary slackness, or freedom of movement for a good practice of snowboarding is essentially provided by the flexible side of the tightening system and of the shoe which is associated therewith. This slackness is not always correctly controlled.

Another so-called "step-in"-type binding, i.e., with automatic fitting is known, which includes two opposing anchoring devices arranged laterally on the shoe. One of these devices cooperates with a retention means affixed to a base connected to the board, the engagement being initially done by means of a lateral displacement of the shoe. The other anchoring device cooperates with a latching system which includes a latch journalled on a jaw and constantly biased in a closing position against the action of one or more return springs. Secondly, the engagement of the second anchoring device is done vertically in the latching system after the lateral engagement of the first anchoring device.

Such a device is currently sold by the company under the mark "SWITCH". It has the advantage of enabling an easy and automatic fitting, which is entirely visible to the user.

However, this device maintains the sole of the shoe firmly connected to the board without possibility of movement, especially a lateral movement. This static assembly causes a number of disadvantages.

When taking turns, or making certain jumps or figures, the rider or snowboarder needs a more or less substantial lateral slackness of the lower part of the leg, in particular on the internal or medial side, in the direction in which the knees come close together. For the device of the prior art, the shoe must be capable of deformation. When that is not the case, the movements of the rider are hindered by a limitation of the amplitude of these internal flexional movements. Generally, it is not easy to control the general slackness by adapting the construction of the shoe for this sole purpose. In addition, the flexibility can vary as a function of the temperature, and over time with respect to the materials that are generally used in the manufacture of a shoe.

SUMMARY OF THE INVENTION

An object of the present invention is to propose an improvement to the apparatus of the prior art which provides both the convenience and reliability of the automatic fitting and the controlled lateral slackness, or freedom of movement necessary for the practice of the sport.

To this end, the invention relates to an apparatus for retaining a snowboard shoe on a board including:

- a first anchoring device affixed to a first lateral side of the sole of the snowboard shoe;
- a second anchoring device affixed to a second lateral side of the sole;
- a base affixed to the board and on which are mounted:
  - an arrangement for rotationally guiding and vertically retaining the first anchoring device;
  - an arrangement for latching the second anchoring device composed of a jaw member having a housing for receiving the second anchoring device, a latch journalled on the jaw member, at least one elastic member which constantly biases the latch in a closing position of the housing;

wherein the latching device includes an elastic return mechanism biased during the displacement of one portion at least of the latching devices which is driven by the thrust exerted by the second anchoring device moving vertically, substantially along an arc whose radius is equivalent to the distance separating the two anchoring devices during the tilting of the shoe on the first side about the axis of rotation of the first anchoring device.

BRIEF DESCRIPTION OF DRAWINGS

Other characteristics and advantages of the invention will be better understood by means of the description that follows, with reference to the annexed drawings which illustrate the present invention by way of example, and in which.

DETAILED DESCRIPTION OF THE PREFERRED EMBODIMENTS

Figure 1:
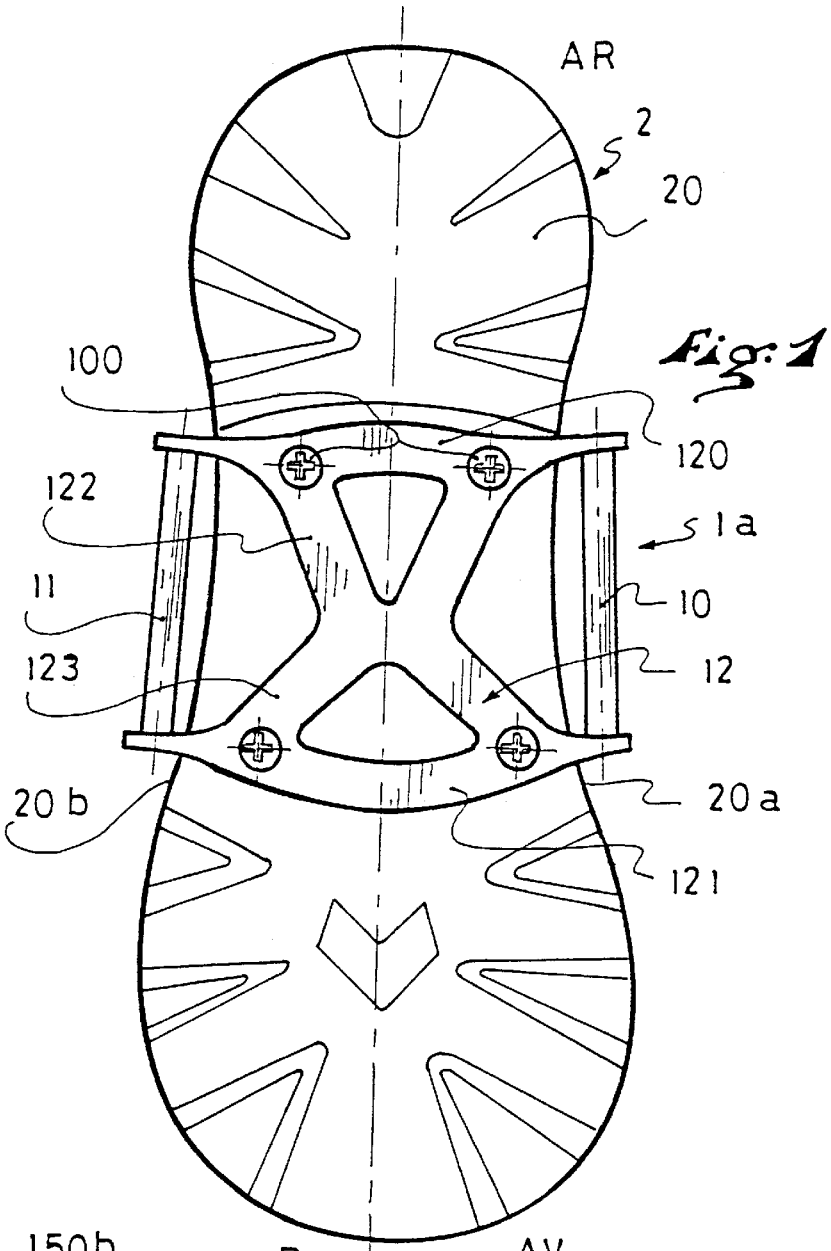
FIG. 1 is a view of the sole of a snowboard shoe including the complementary portion of the device of FIG. 1.
Figure 2:
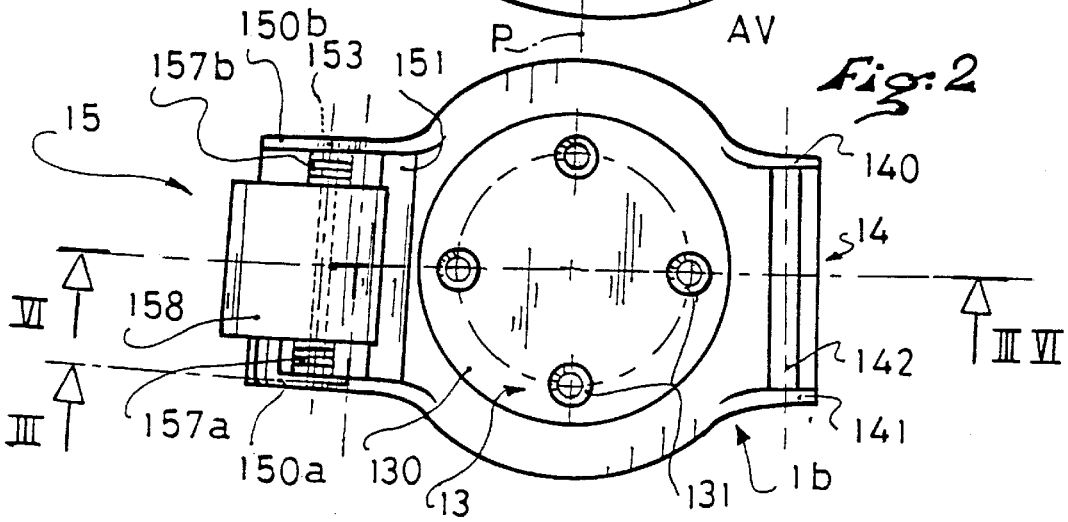
FIG. 2 is a top view of a portion of the apparatus according to the invention.

FIGS. 1 and 2 show the device or apparatus 1 according to the invention which is composed of a shoe insert 1*a*, on the one hand, and of the retention device 1*b* adapted to cooperate with the insert 1*a*, on the other hand.

The insert 1*a* is fixed under the sole 20 of the snowboard shoe 2 by screws 100, for example, as shown. It is extended on one of the lateral sides 20*a* of the sole by a first anchoring device 10, and on the opposite side 20*b* by a second anchoring device 11. The two anchoring devices project beyond the contour of the sole 20. They are each presented as a rectilinear portion of a rod or pin oriented in a longitudinal direction substantially parallel with respect to the longitudinal plane P of the shoe, so that the apparatus of the invention can be fitted differently by both a "goofy" or a "regular" user.

The portions of the pin are connected to one another by a stiffening frame 12 anchored in the sole of the shoe. This frame has two transverse main members 120, 121, and crossed members 122, 123 connecting the transverse members, thus providing a sufficient resistance to the twisting of the anchoring devices.

The other portion of the apparatus 1, shown in FIG. 2, is the actual retention device 1*b* with a base 13 that can be oriented on the board (not shown) by means of a central disk 130 adapted to be fixed on the board by screws extending through aperatures 131. The base is extended on one side by an arrangement 14 for rotationally guiding and vertically retaining the first anchoring device 10, and on the other side by a member 15 for latching the second anchoring device 11.

The rotational guiding arrangement includes a pair of vertical wings 140, 141 extending upwardly from the base and longitudinally spaced apart. They are connected by a pin 142 which merely ensures the torsional strength of the wings 140, 141. Each wing 140, 141 is provided with a U-shaped housing 143 open toward the exterior (EXT) for receiving the portion of the pin of the first anchoring device 10 (FIGS. 3 and 4).

Figure 3:
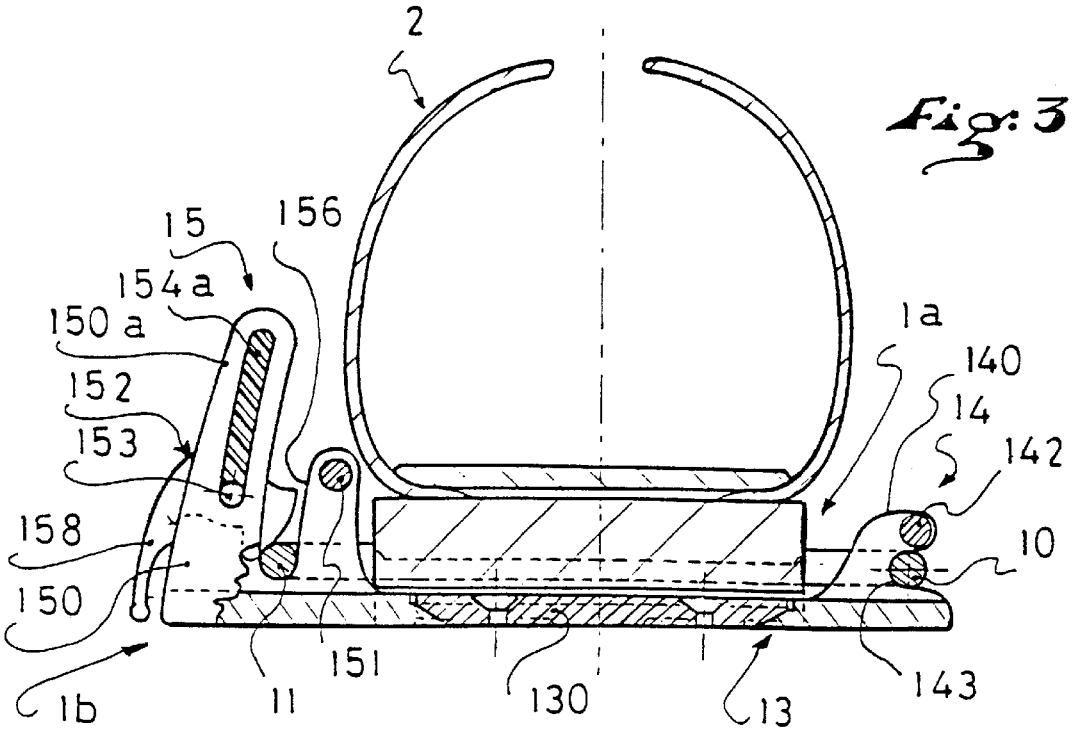
FIG. 3 is a cross sectional view along the line III—III of the device of FIG. 2.
Figure 4:
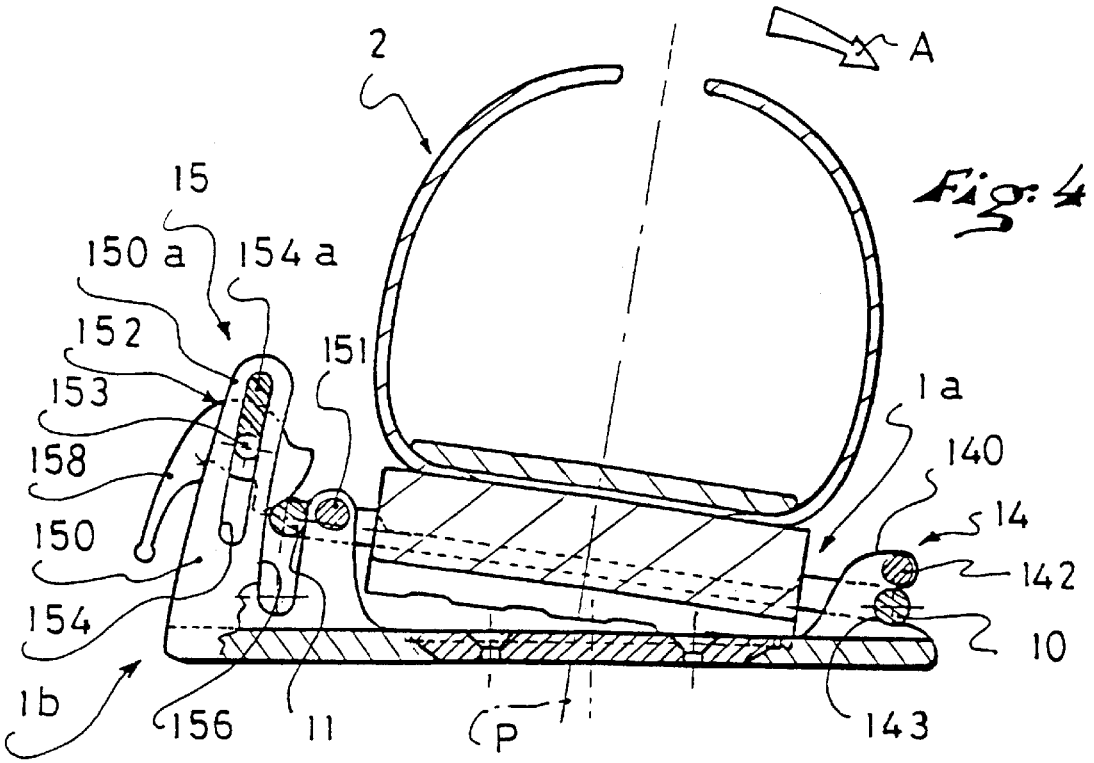
FIG. 4 is a view similar to FIG. 3 when the apparatus is biased by the tilting of the shoe.

With respect to FIGS. 3 and 4, the latching mechanism 15 is arranged substantially on the side opposite the guiding arrangement 14 on the base with respect to the central disk 130. It includes a jaw member 150 formed by two substantially vertical and parallel wings 150*a*, 150*b*, which extend upwardly from the base and are connected by a pin-shaped spacer 151.

The jaw member also has a U-shaped housing 156 carried on each wing, extending substantially vertically and open upwardly, to allow for a substantially vertical engagement of the portion of the pin of the second anchoring device 11.

A latch 152 journalled along an axis 153 is maintained in a closing position of the housing 156 due to the action of an elastic member which biases it constantly.

As shown in FIG. 2, such an elastic member can be represented, for example, by two hairpin springs 157*a*, 157*b* mounted on the journal axis 153 of the latch.

The latching mechanism also has a lever 158 which affixedly extends the latch 152 and whose activation causes the compression of the elastic member, i.e., of the two hairpin springs 157*a*, 157*b*, and displaces the latch, which makes a rotation, toward an opening position of the housing, thus making it possible to release the first anchoring device 11.

The latch 152 is journalled along the axle or pin 153 guided through oblong holes 154 provided on the wings 150*a*, 150*b* of the jaw member. The upper portion of each hole is occupied by an elastic return device 154*a* of the axle 153. Preferably, this can be blocks of elastomeric material, for example.

FIG. 3 shows the device when the shoe is flat on the base and in a latching position. The axle 153 is maintained at the bottom of each hole 154 by the compression exerted by each elastomeric block 154*a* occupying the remainder of the oblong recess.

FIG. 4 shows the apparatus when the shoe tilts in the direction of the arrow A, on the side opposite the latching mechanism and about the axis of the first anchoring device 10. In this case, the portion of the pin of the second anchoring device 11 occupying the housing 156, exerts a substantially vertical force on the latch which tends to raise it. The axle 153 translates upwardly into the oblong hole and then compresses the blocks 154*a*. The return to the initial position is promoted by the elastic return exerted by the elastomeric blocks 154*a*.

The portion of the pin 11 of the anchoring device 11 is displaced along a line in an arc of a circle in the housing 156, located at a distance whose radius is equivalent to the distance between the centers of the anchoring devices 10, 11. Thus, for a correct functioning of the device, it is necessary to provide a shape for the housing which adapts to the displacement of the portion of the pin 11, i.e., which extends substantially in an arc of a circle.

Likewise, the oblong hole 154 must also have the shape of an arc of a circle, concentric with respect to the arc of the housing 156, for maintaining the latch in its closing position all along its vertical displacement.

Figure 5:
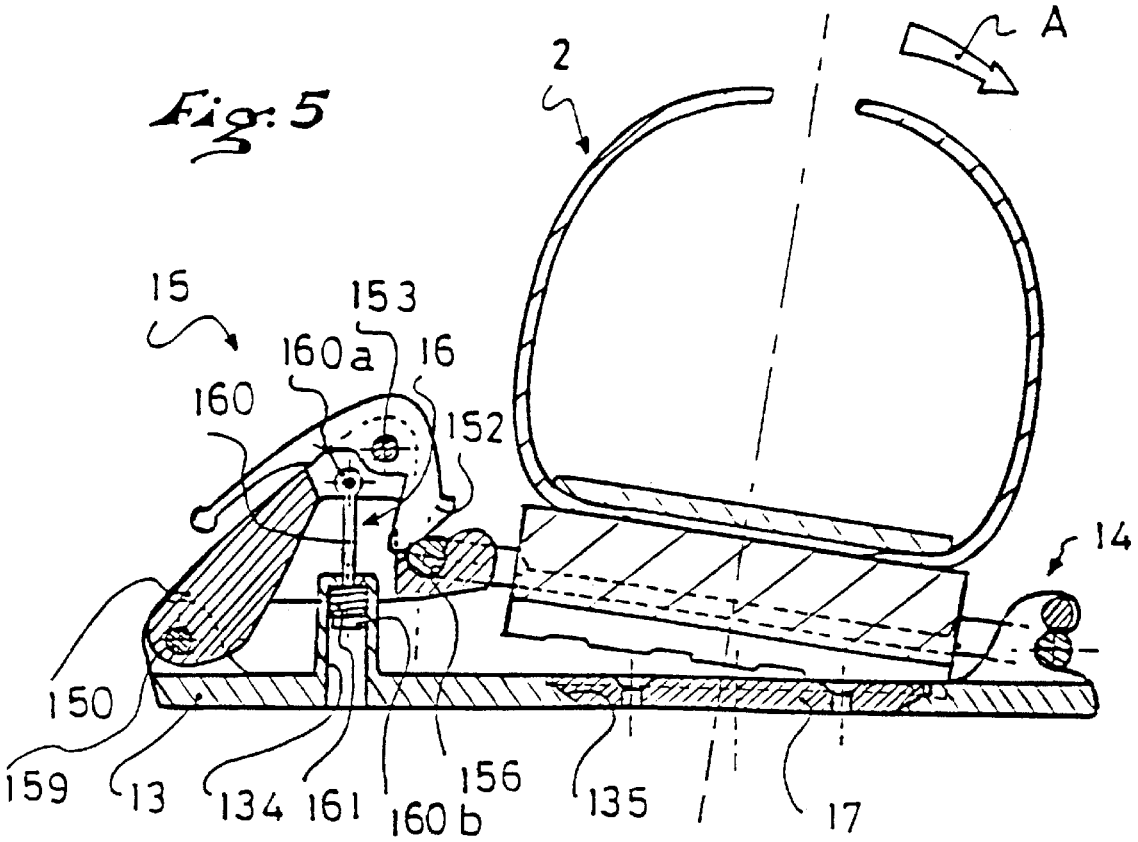
FIG. 5 is a view similar to that of FIG. 4 according to an alternative embodiment of the invention.

FIG. 5 shows another possible embodiment of the invention. In this case, the jaw member 150 of the latching mechanism 15 is directly journalled on the base 13 along the axis 159, on the one hand, and is connected to the base by an elastic return mechanism 16, on the other hand. This mechanism is composed of a rod 160 whose first end 160*a* is connected by a journal to the jaw member and whose second end extends into a tubular portion 134 of the base, and is connected to a resilient element 161, preferably a spring, biased in compression in the tubular portion 134 during the tilting of the shoe in the direction indicated by the reference character A.

The latch 152 is also journalled along the axle 153 on the movable jaw member to merely allow the rotation thereof between an opening position and a closing position of the housing 156. As provided for in the previously discribed embodiment, an elastic member of the type having hairpin springs (not shown) constantly biases the latch in the closing position of the housing.

Figure 6:
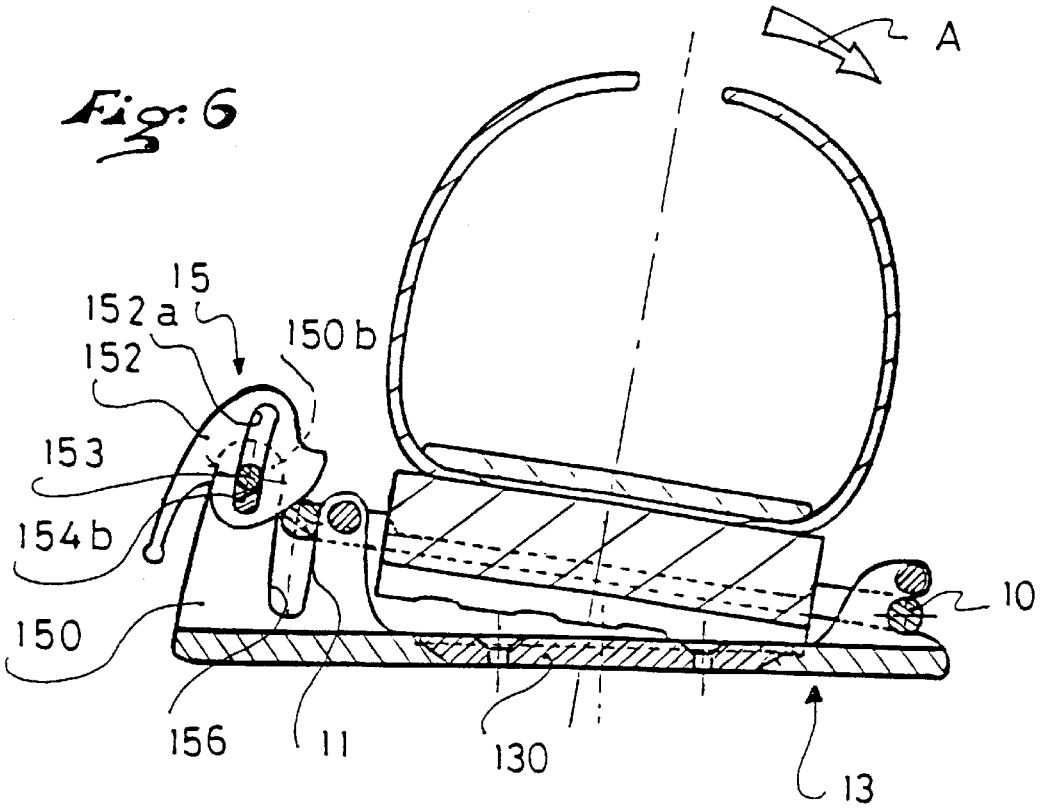
FIG. 6 is a cross sectional view along the line VI—VI of the apparatus of FIG. 2 according to another alternative embodiment.

FIG. 6 shows another possible embodiment of the invention. The latch 152 includes an oblong hole 152*a* in which passes an axle 153 fixedly connected to the jaw member 150, and more specifically on each wing 150*a*, 150*b*, of the jaw member. The lower portion of the hole 152*a* is occupied by an elastic return mechanism 154*b*, preferably a block of elastomeric material. In this way also, it is the latch which is translationally movable with respect to the jaw member whose axle 153 biases in compression the elastic member housed in the latch, during the tilting of the shoe along A.

As described previously, the return to the lower position of the latch is promoted by the elastic return exerted by the elastomeric block 154*b* contained in the latch.

In all of the embodiments shown, the base 13 includes a hole in its central portion located between the guiding arrangement 14 and the latching mechanism 15, through which the central disk 11, adapted to be fixed on the gliding board, takes position. The disk takes support on the edge 135 of the central hole to immobilize the base by compression in a predetermined angular position.

The invention is not limited to the embodiments thus described, and it includes all of the technical equivalents that fall within the scope of the following claims.

What is claimed is:

1. An apparatus for retaining a snowboard shoe on a board, said apparatus including:

a first anchoring device adapted to be affixed to a first lateral side of the sole of the snowboard shoe;

a second anchoring device adapted to be affixed to a second lateral side of said sole;

a base adapted to be affixed to the board and on which are mounted:

an arrangement that rotationally guides and vertically retains the first anchoring device with respect to the board;

a latching mechanism for the second anchoring device, said latching mechanism including a jaw member having a housing for receiving the second anchoring device, a latch journalled on the jaw member for movement between an open position, to receive the second anchoring device into the housing, and a latched position to retain the second anchoring device against release from the housing, at least one elastic member which constantly biases the latch toward the latched position;

wherein the latching mechanism further includes an elastic return device biased during an upwardly directed displacement of one portion at least of the latching mechanism, said displacement being driven by an upwardly directed thrust exerted by the second anchoring device, substantially along an arc having a radius equivalent to a distance separating the two anchoring devices during a tilting of the shoe on the first lateral side about an axis of rotation defined by a portion of the first anchoring device.

2. An apparatus according to claim 1, wherein the latch is journalled along an axis of a journal, said journal being guided through oblong holes of the jaw member, in an upper portion of which said elastic return device, is biased in compression during the upwardly directed displacement of the second anchoring device.

3. An apparatus according to claim 2, wherein the elastic return device is in the form of elastomeric blocks.

4. An apparatus according to claim 1, wherein the jaw member is journalled on the base and is connected to the base by an elastic return device.

5. An apparatus according to claim 4, wherein the elastic return device is composed of a journalled rod whose first end is connected to the jaw member and whose second end extends into a tubular portion of the base, and is connected to a resilient element, biased in compression in the tubular portion during the tilting of the shoe.

6. An apparatus according to claim 5, wherein the first end is journalled on the jaw member.

7. An apparatus according to claim 5, wherein the resilient element is a spring.

8. An apparatus according to claim 1, wherein the latch comprises an oblong hole in which an axle fixedly connected to the jaw member passes.

9. An apparatus according to claim 1, wherein the first and second anchoring devices each have a rectilinear portion oriented in a longitudinal direction adapted to be substantially parallel with respect to a longitudinal median plane P of the shoe.

10. An apparatus according to claim 9, wherein the rectilinear portions of the anchoring devices are connected to one another by a stiffening frame adapted to be anchored to the sole of the boot.

11. An apparatus according to claim 9, wherein the arrangement that rotationally guides and vertically retains the first anchoring device includes a pair of upwardly extending wings, the wings being longitudinally spaced apart and connected by a pin, each wing being provided with a U-shaped housing open toward the exterior for receiving the rectilinear portion of the first anchoring device.

12. An apparatus according to claim 9, wherein the housing of the jaw member has a shape of a U, whose opening is turned upwardly to allow a substantially vertical engagement of the rectilinear portion of the second anchoring device.

13. An apparatus according to claim 9, wherein the rectilinear portions of the first and second anchoring devices are positioned to be outside a contour of the sole of the shoe.

14. An apparatus according to claim 9 in combination with the snowboard shoe, wherein the rectilinear portions of the first and second anchoring devices are positioned outside a contour of the sole of the shoe.

15. An apparatus according to claim 1, wherein the latching mechanism includes a guiding structure to guide said one portion of the latching mechanism for said displacement in a direction away from the board while the second anchoring device is retained in the housing in the latched position of the latch.

16. An apparatus for retaining a snowboard shoe on a snowboard, said apparatus including:

(a) a shoe insert adapted to be affixed to a sole of the snowboard shoe, said shoe insert comprising a first anchoring device adapted to extend from a first lateral side of the sole of the shoe and a second anchoring device adapted to extend from a second lateral side of the sole, said first and second anchoring devices being connected by a stiffening frame, the stiffening frame being adapted to be affixed to the sole;

(b) a retention device adapted to be affixed to the snowboard and to retain the shoe insert, said retention device comprising:

(i) a base adapted to be affixed to the snowboard;

(ii) a rotational guiding structure for rotationally guiding the shoe insert, the structure including a housing for receiving, engaging and vertically retaining the first anchoring device, the shoe insert being rotationally guided in the housing about an axis extending through a portion of the first anchoring device;

(iii) a latching mechanism for the second anchoring device, said latching mechanism including:

(A) a jaw member having a housing for receiving the second anchoring device;

(B) a latch journalled on the jaw member for movement between an open position, to receive the second anchoring device into the housing, and a latched position to retain the second anchoring device against release from the housing;

(C) at least one elastic member for biasing the latch in a direction toward the latched position;

(D) at least one portion of the latching mechanism being mounted for an upward displacement;

(E) an elastic return device biased during said upward displacement of said portion of the latching mechanism, said upward displacement being driven by an upward arcuate displacement of the second anchoring device about the axis extending through the portion of the first anchoring device;

(F) the rotational guiding structure and the latching mechanism being positioned on the base.

17. An apparatus according to claim 16, wherein the latching mechanism includes a guiding structure to guide said portion of the latching mechanism for said upward displacement while the second anchoring device is retained in the housing in the latched position of the latch.

18. An apparatus according to claim 16, wherein the first and second anchoring devices are positioned to be outside a contour of the sole of the shoe.

19. An apparatus according to claim 16 in combination with the snowboard shoe, wherein the first and second anchoring devices are positioned outside a contour of the sole of the shoe.

* * * * *